US012103742B2

(12) United States Patent
Berge et al.

(10) Patent No.: US 12,103,742 B2
(45) **Date of Patent: *Oct. 1, 2024**

(54) TETHERED FLIP CLOSURE

(71) Applicant: Silgan White Cap LLC, Downers Grove, IL (US)

(72) Inventors: Gary L. Berge, Crystal Lake, IL (US); Thomas P. Hennessy, Naperville, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/361,181

(22) Filed: Jul. 28, 2023

(65) Prior Publication Data

US 2023/0365305 A1 Nov. 16, 2023

Related U.S. Application Data

(63) Continuation of application No. 17/558,033, filed on Dec. 21, 2021, now Pat. No. 11,753,217, which is a continuation of application No. 16/520,958, filed on Jul. 24, 2019, now Pat. No. 11,214,413.

(51) Int. Cl.
*B65D 47/08* (2006.01)
*B65D 47/10* (2006.01)

(52) U.S. Cl.
CPC ..... *B65D 47/0842* (2013.01); *B65D 47/10* (2013.01)

(58) Field of Classification Search
CPC .... B62J 9/23; F16J 15/10; F16J 15/027; F16J 15/062
See application file for complete search history.

(56) References Cited

U.S. PATENT DOCUMENTS

| | | | |
|---|---|---|---|
| 4,333,577 | A | 6/1982 | Mumford |
| 4,394,918 | A | 7/1983 | Grussen |
| 5,056,675 | A | 10/1991 | Julian |
| 5,335,802 | A | 8/1994 | Brach et al. |
| 5,779,110 | A | 7/1998 | Brown et al. |

(Continued)

FOREIGN PATENT DOCUMENTS

| | | |
|---|---|---|
| EP | 1135302 | 4/2003 |
| JP | 2013-203471 | 10/2013 |

(Continued)

OTHER PUBLICATIONS

International Search Report and Written Opinion for International Application No. PCT/US2020/038321, dated Sep. 25, 2020, 13 pages.

*Primary Examiner* — James N Smalley
(74) *Attorney, Agent, or Firm* — Reinhart Boerner Van Deuren s.c.

(57) ABSTRACT

A closure includes a hinged sealing element including a top wall and a first skirt. The first skirt has a sealing formation allowing engagement of a mating sealing formation of a bottle. A second skirt has an attachment formation engageable with a mating attachment formation of the bottle. A plurality of frangible members is attached to each of the skirts. A pair of hinge members is attached between the first and second skirts. A biasing member is attached to the first skirt between the hinge members and extending downwardly from the first skirt to interact with a neck portion of the bottle such that the sealing formation of the first skirt and the mating sealing formation of the bottle are biased toward each other.

20 Claims, 6 Drawing Sheets

(56) References Cited

U.S. PATENT DOCUMENTS

| | | | |
|---|---|---|---|
| 6,152,320 | A | 11/2000 | Hierzer et al. |
| 6,253,937 | B1 | 7/2001 | Anderson |
| 6,321,923 | B1 | 11/2001 | Wood |
| 6,419,101 | B1 | 7/2002 | Hessel et al. |
| 6,474,491 | B1 | 11/2002 | Benoit-Gonin et al. |
| 6,478,184 | B2 | 11/2002 | Berge et al. |
| 6,481,588 | B1 | 11/2002 | Wagner |
| 7,051,888 | B2 | 5/2006 | Antier et al. |
| 7,073,679 | B1 | 7/2006 | Lagler et al. |
| 7,243,807 | B2 | 7/2007 | Lin |
| 7,731,042 | B2 | 6/2010 | Blomdahl et al. |
| 8,056,749 | B2 | 11/2011 | Robinson |
| 8,794,460 | B2 | 8/2014 | Druitt et al. |
| 10,654,624 | B2 | 5/2020 | Sung |
| 10,654,625 | B2 | 5/2020 | Migas et al. |
| 2020/0180819 | A1 | 6/2020 | Berroa Garcia |

FOREIGN PATENT DOCUMENTS

| | | |
|---|---|---|
| JP | 2019-055816 | 4/2019 |
| KR | 10-2018-0102476 | 9/2018 |
| WO | WO2007-015648 | 2/2007 |
| WO | WO2019/043274 | 3/2019 |

TETHERED FLIP CLOSURE

CROSS-REFERENCE TO RELATED PATENT APPLICATIONS

This application is a continuation of U.S. application Ser. No. 17/558,033, filed Dec. 21, 2021, which is a continuation of U.S. application Ser. No. 16/520,958, now U.S. Pat. No. 11,214,413, filed Jul. 24, 2019, each of which is incorporated herein by reference in its entirety.

BACKGROUND OF THE INVENTION

The present disclosure relates generally to the field of closures for bottles. The present disclosure relates specifically to a closure for a bottle that provides tamper evidence. The closure can remain on the bottle up until disposal or recycling of the bottle.

SUMMARY OF THE INVENTION

A closure, for closing a bottle having a neck portion including a mating sealing formation and a mating attachment formation, includes a hinged sealing element. The hinged sealing element includes a top wall and a first skirt extending downwardly from the top wall. The first skirt includes a circumference, an inner surface, and an outer surface. The inner surface has a sealing formation that allows engagement of the mating sealing formation of the bottle. A tab is attached to the outer surface of the first skirt. The first skirt extends below and perpendicular to the top wall down to a lower edge of the first skirt. A second skirt defines an inner surface, an outer surface, a top edge, and a circumference larger than the circumference of the first skirt. The inner surface of the second skirt has an attachment formation engageable with the mating attachment formation of the bottle. The second skirt extends downward in a same direction as the first skirt. A plurality of frangible members each has first and second edges and are each attached to a respective skirt to form a gap between the first and second skirts. The first edges of the frangible members are each attached to the first skirt with frangible formations. A pair of hinge members is attached between the first and second skirts within the gap. A biasing member is attached to the first skirt between the hinge members and extends downwardly from the first skirt to interact with the neck portion of the bottle such that the sealing formation of the inner surface of the first skirt and the mating sealing formation of the bottle are biased toward each other.

A closure, for closing a bottle having a neck portion including a mating sealing formation and a mating attachment formation, includes a hinged sealing element including a top wall and a first skirt extending downwardly from the top wall. The first skirt includes a circumference, an inner surface, and an outer surface. The inner surface has a sealing formation that allows engagement of the mating sealing formation of the bottle. The sealing formation includes an outer section and an inner section, with the outer section defining a circumference, and the inner section defining a circumference smaller than the circumference of the outer section. A space is between the outer section and the inner section to receive the mating sealing formation of the bottle. The outer section creates an outer seal with the mating sealing formation of the bottle, and the inner section creates a plug seal with the mating sealing formation of the bottle. A tab is attached to the outer surface of the first skirt. The first skirt extends below and perpendicular to the top wall down to a lower edge of the first skirt. A second skirt defines an inner surface, an outer surface, a top edge, and a circumference larger than the circumference of the first skirt. The inner surface of the second skirt has an attachment formation engageable with the mating attachment formation of the bottle. The second skirt extends downward in a same direction as the first skirt. A plurality of frangible members each has first and second edges and are each attached to a respective skirt to form a gap between the first and second skirts. The first edges of the frangible members are attached to the first skirt with frangible formations. A pair of hinge members is attached between the first and second skirts within the gap. A biasing member is attached to the first skirt between the hinge members and extends downwardly from the first skirt to interact with the neck portion of the bottle such that the sealing formation of the inner surface of the first skirt and the mating sealing formation of the bottle are biased toward each other.

A closure, for closing a bottle having a neck portion including a mating sealing formation and a mating attachment formation, includes a hinged sealing element including a top wall and a first skirt extending downwardly from the top wall. The first skirt includes a circumference, an inner surface, and an outer surface. The inner surface has a sealing formation that allows engagement of the mating sealing formation of the bottle. The sealing formation includes an outer section and an inner section, with the outer section defining a circumference, and the inner section defining a circumference smaller than the circumference of the outer section. A space is between the outer section and the inner section to receive the mating sealing formation of the bottle. The outer section creates an outer seal with the mating sealing formation of the bottle, and the inner section creates a plug seal with the mating sealing formation of the bottle. A tab is attached to the outer surface of the first skirt. The first skirt extends below and perpendicular to the top wall down to a lower edge of the first skirt. A second skirt defines an inner surface, an outer surface, a top edge, and a circumference larger than the circumference of the first skirt. The inner surface of the second skirt has an attachment formation engageable with the mating attachment formation of the bottle. The attachment formation of the second skirt includes a plurality of threads spaced around the circumference of the inner surface of the second skirt. The second skirt extends downward in a same direction as the first skirt. A plurality of frangible members each has first and second edges and are each attached to a respective skirt to form a gap between the first and second skirts. The first edges of the frangible members are each attached to the first skirt with frangible formations. A pair of hinge members is attached between the first and second skirts within the gap. A biasing member is attached to the first skirt between the hinge members and extends downwardly from the first skirt to interact with the neck portion of the bottle such that the sealing formation of the inner surface of the first skirt and the mating sealing formation of the bottle are biased toward each other.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding and are incorporated in and constitute a part of this specification. The drawings illustrate one or more embodiments and together with the description serve to explain principles and operation of the various embodiments.

DETAILED DESCRIPTION

Figure 1:
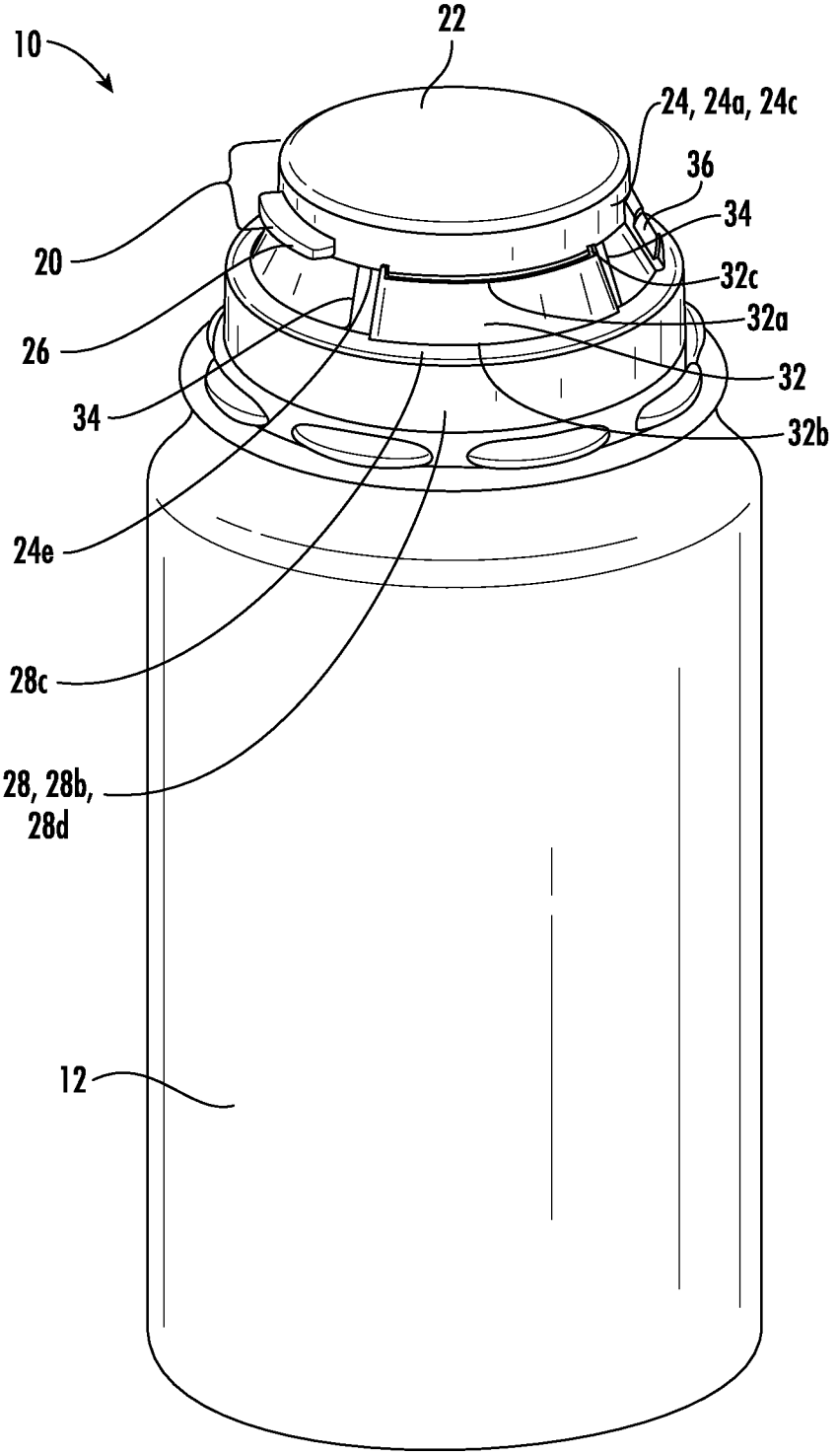
FIG. 1 is a perspective view of a closure in a closed position on a bottle, according to an exemplary embodiment.
Figure 2:
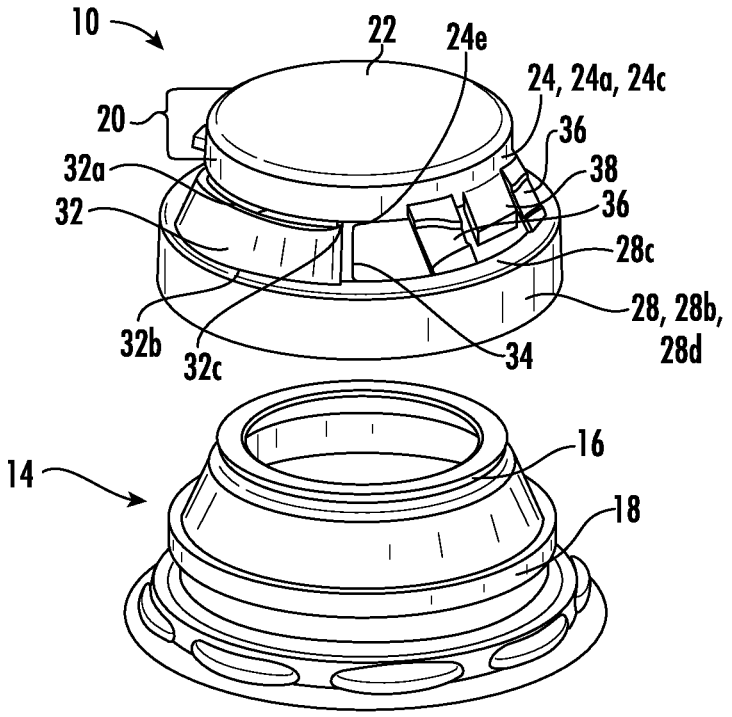
FIG. 2 is an exploded view of a closure and a bottle, according to an exemplary embodiment.
Figure 3:
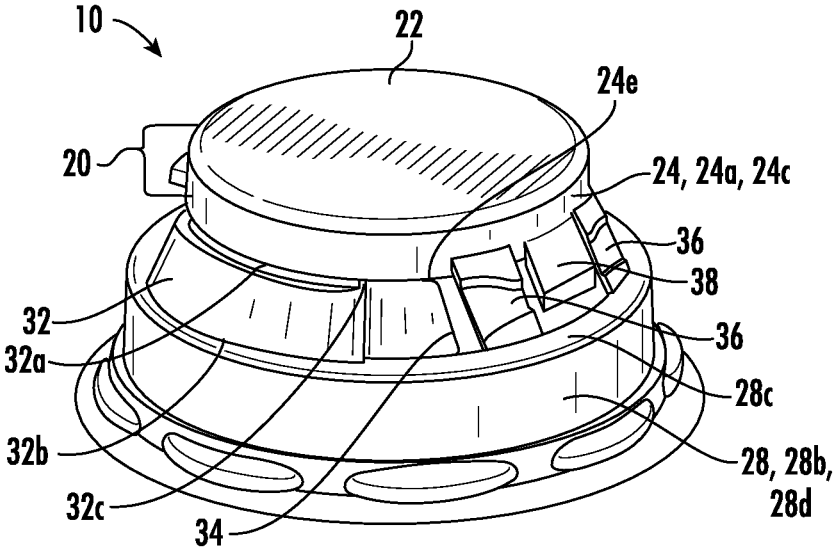
FIG. 3 is a perspective view of a closure in a closed position on a bottle, according to an exemplary embodiment.

Referring to FIGS. 1-3, an embodiment of a closure 10, for closing a bottle 12 having a neck portion 14 including a mating sealing formation 16 and a mating attachment formation 18, includes a hinged sealing element 20. The hinged sealing element 20 includes a top wall 22 and a first skirt 24 extending downwardly from the top wall 22. The first skirt 24 includes a circumference 24*a*, an inner surface 24*b* (FIG. 7), and an outer surface 24*c*. As detailed in FIG. 6, the inner surface 24*b* has a sealing formation 24*d* that allows engagement of the mating sealing formation 16 of the bottle 12. A tab 26 is attached to the outer surface 24*c* of the first skirt 24. The first skirt 24 extends below and perpendicular to the top wall 22 down to a lower edge 24*e* of the first skirt 24.

Typically, closure 10 is injection molded from a plastic such as HDPE and typical containers are formed from plastics such as HDPE.

Figure 4:
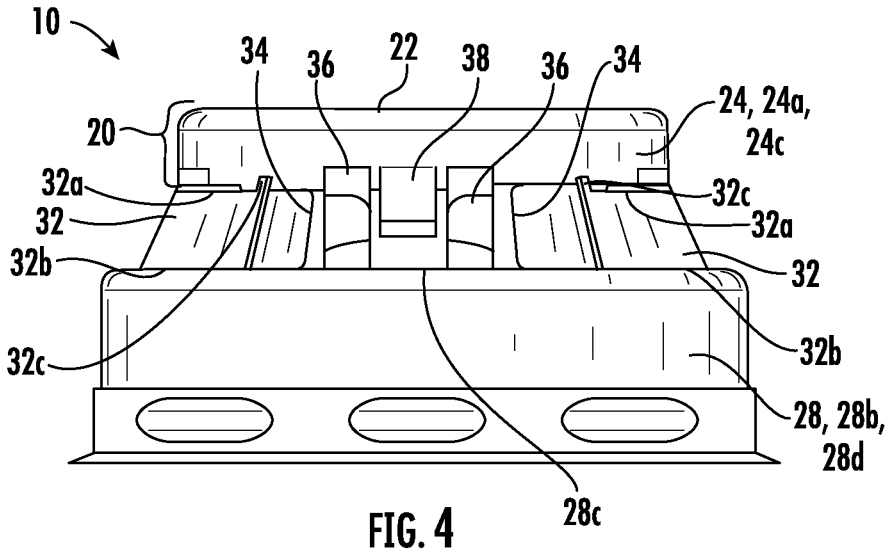
FIG. 4 is a rear/side view of a closure in a closed position on a bottle, according to an exemplary embodiment.
Figure 5:
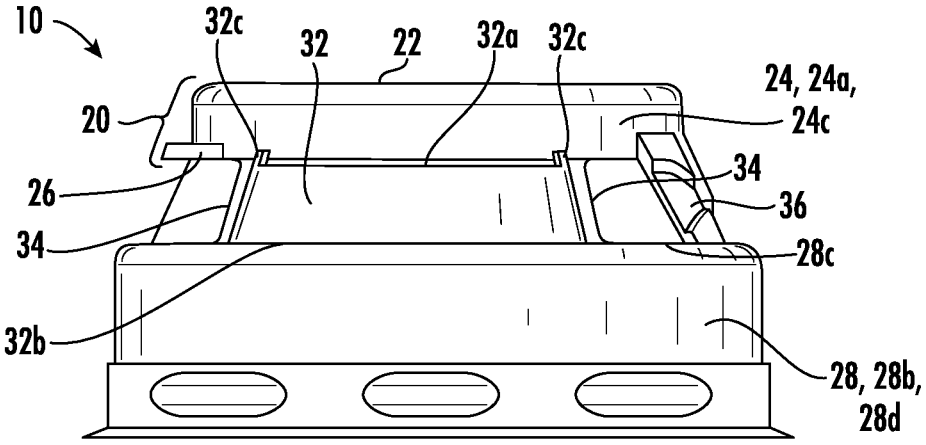
FIG. 5 is a side view of a closure in a closed position on a bottle, according to an exemplary embodiment.
Figure 6:
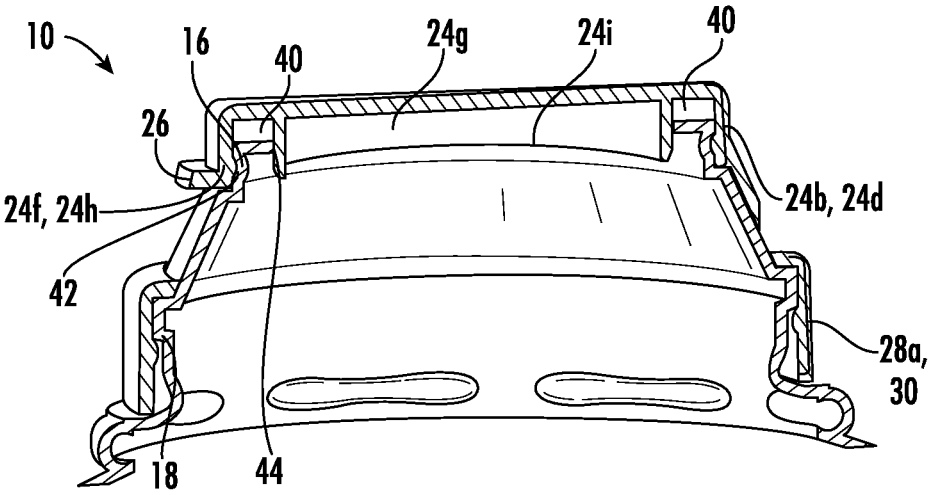
FIG. 6 is a perspective view of an inner surface of a closure in a closed position on a bottle, according to an exemplary embodiment.

FIGS. 4 and 5 illustrate that the closure 10 also includes a second skirt 28 that defines an inner surface 28*a*, an outer surface 28*b*, a top edge 28*c*, and a circumference 28*d* larger than the circumference 24*a* of the first skirt 24. FIG. 6 shows that the inner surface 28*a* of the second skirt 28 has an attachment formation 30 that is engageable with the mating attachment formation 18 of the bottle 12. The second skirt 28 extends downward in a same direction as the first skirt 24.

Figure 8:
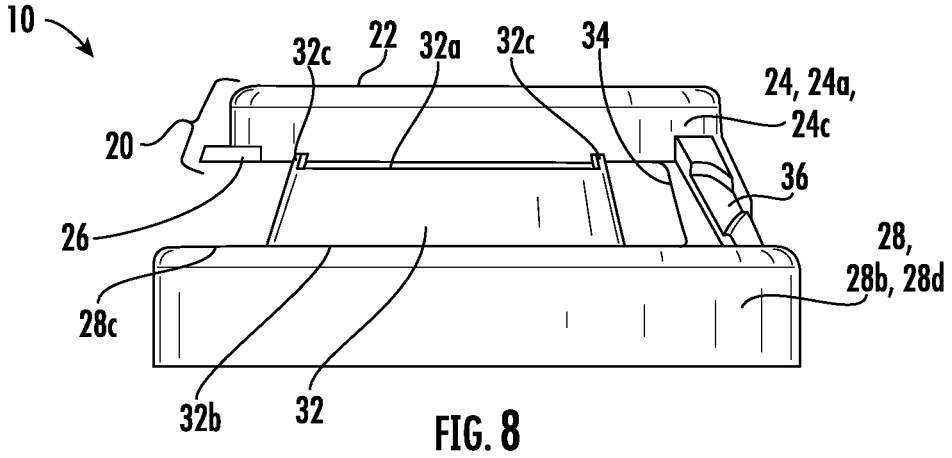
FIG. 8 is a side view of a closure in a closed position on a bottle, according to an exemplary embodiment.

Further, the closure 10 includes a plurality of frangible members 32 that each have first 32*a* and second edges 32*b*, best shown in FIG. 8. The frangible members 32 are each attached to a respective skirt 24, 28 to form a gap 34 between the first and second skirts 24, 28. The first edges 32*a* of each of the frangible members 32 is attached to the first skirt 24 with frangible formations 32*c*, also depicted in FIG. 8.

FIG. 3 illustrates that the closure 10 also includes a pair of hinge members 36, each attached between the first and second skirts 24, 28 within the gap 34.

Additionally in FIG. 3, the closure 10 includes a biasing member 38 attached to the first skirt 24 between the hinge members 36. The biasing member 38 extends downwardly from the first skirt 24 to interact with the neck portion 14 of the bottle 12 such that the sealing formation 24*d* of the inner surface 24*b* of the first skirt 24 and the mating sealing formation 16 of the bottle 12 are biased toward each other.

Figure 7:
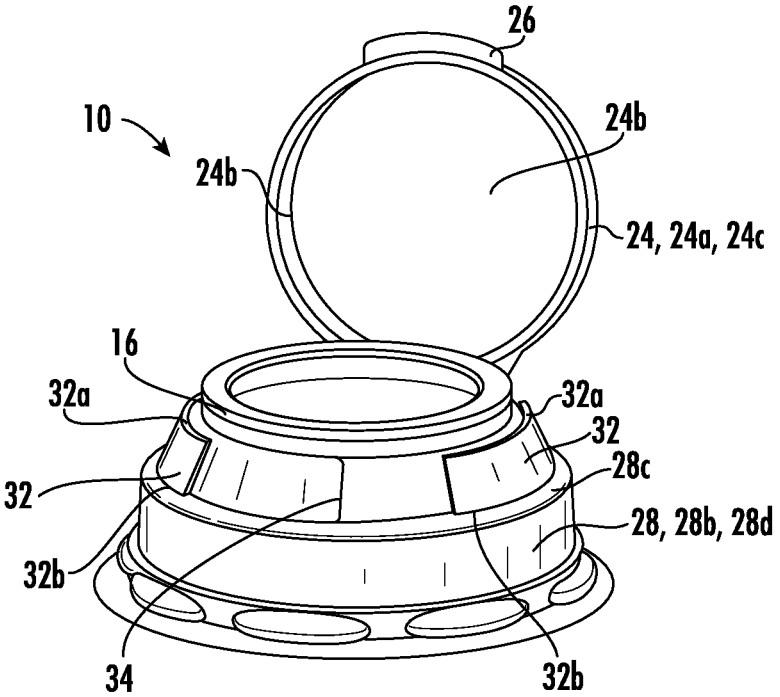
FIG. 7 is a perspective view of a closure in an open position on a bottle, according to an exemplary embodiment.

In another embodiment of the closure 10, depicted in FIG. 7, the lower edge 24*e* of the first skirt 24 detaches from the frangible formations 32*c* of the first edges 32*a* of each the frangible members 32 upon lifting the tab 26. The first skirt 24 is moved from a closed position to an open position. The pair of hinge members 36 and the biasing member 38 allows the first skirt 24 to remain in the open position.

Figure 10:
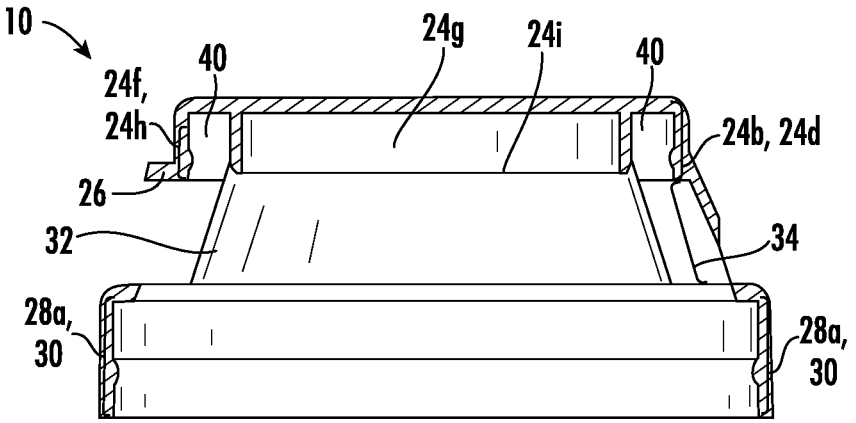
FIG. 10 is a cross-sectional view taken along line A-A of FIG. 9 of a closure in a closed position on a bottle, according to an exemplary embodiment.

In a further embodiment of the closure 10, depicted in both FIGS. 6 and 10, the inner surface 24*b* of the first skirt 24 includes an outer section 24*f* and an inner section 24*g*. The outer section 24*f* of the inner surface 24*b* of the first skirt 24 defines a circumference 24*h*. The inner section 24*g* of the inner surface 24*b* of the first skirt 24 defines a circumference 24*i* smaller than the circumference 24*h* of the outer section 24*f*. A space 40 is between the outer section 24*f* and the inner section 24*g* to receive the mating sealing formation 16 of the bottle 12. The outer section 24*f* creates an outer seal 42 with the mating sealing formation 16 of the bottle 12, and the inner section 24*g* creates a plug seal 44 with the mating sealing formation 16 of the bottle 12.

In yet another embodiment of the closure 10, first shown in FIGS. 1 and 2, the plurality of frangible members 32 is positioned at an angle from 0 degrees to 130 degrees, relative to a horizontal axis. In a specific embodiment, the plurality of frangible members 32 is positioned at an angle from greater than 0 degrees to 130 degrees, relative to the horizontal axis.

Figure 9:
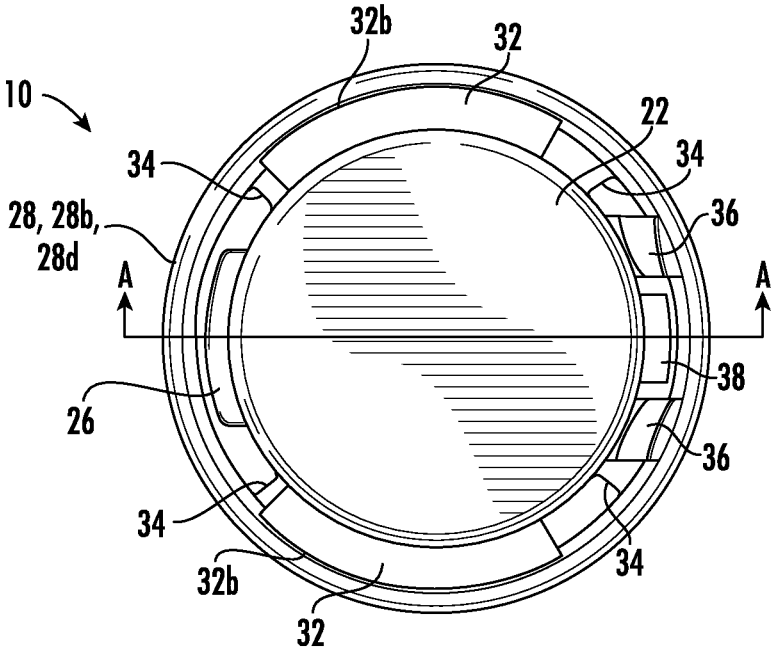
FIG. 9 is a top view of a closure in a closed position on a bottle, according to an exemplary embodiment.

In yet a further embodiment of the closure 10, illustrated in FIG. 9, the plurality of frangible members 32 is spaced around a portion of the circumference 24*a* of the first skirt 24, at 90 degrees, or less, angle increments.

In a yet another embodiment of the closure 10, the attachment formation 30 of the second skirt 28 is a plurality of threads (not depicted) spaced around the circumference 28*a* of the inner surface 28*a* of the second skirt 28.

In a yet a further embodiment of the closure 10, similar to FIG. 9, the plurality of frangible members 32 is spaced around a portion of the circumference 24*a* of the first skirt 24, at 90 degrees, or less, angle increments.

Referring to the figures as above, in an embodiment, a closure 10, for closing a bottle 12 having a neck portion 14 including a mating sealing formation 16 and a mating attachment formation 18, includes a hinged sealing element 20. The hinged sealing element 20 includes a top wall 22 and a first skirt 24 extending downwardly from the top wall 22. The first skirt 24 includes a circumference 24*a*, an inner surface 24*b*, and an outer surface 24*c*. The inner surface 24*b* has a sealing formation 24*d* that allows engagement of the mating sealing formation 16 of the bottle 12. The sealing formation 24*d* includes an outer section 24*f* and an inner section 24*g*. The outer section 24*f* of the inner surface 24*b* of the first skirt 24 defines a circumference 24*h*. The inner section 24*g* of the inner surface 24*b* of the first skirt 24 defines a circumference 24*i* smaller than the circumference 24*h* of the outer section 24*f*. A space 40 is between the outer section 24*f* and the inner section 24*g*, to receive the mating sealing formation 16 of the bottle 12. The outer section 24*f* creates an outer seal 42 with the mating sealing formation 16 of the bottle 12, and the inner section 24*g* creates a plug seal 44 with the mating sealing formation 16 of the bottle 12. A tab 26 is attached to the outer surface 24*c* of the first skirt 24. The first skirt 24 extends below and perpendicular to the top wall 22 down to a lower edge 24*e* of the first skirt 24.

The closure 10 also includes a second skirt 28 that defines an inner surface 28*a*, an outer surface 28*b*, a top edge 28*c*, and a circumference 28*d* larger than the circumference 24*a* of the first skirt 24. The inner surface 28*a* of the second skirt 28 has an attachment formation 30 that is engageable with the mating attachment formation 18 of the bottle 12. The second skirt 28 extends downward in a same direction as the first skirt 24.

Furthermore, the closure 10 includes a plurality of frangible members 32 that each have first and second edges 32*a*, 32*b* and are attached to a respective skirt 24, 28 to form a gap 34 between the first and second skirts 24, 28. The first edges 32*a* of the frangible members 32 are each attached to the first skirt 24 with frangible formations 32*c*.

The closure 10 also includes a pair of hinge members 36 that are each attached between the first and second skirts 24, 28 within the gap 34.

Additionally, the closure 10 includes a biasing member 38 attached to the first skirt 24 between the hinge members 36 and extending downwardly from the first skirt 24 to interact with the neck portion 14 of the bottle 12 such that the sealing formation 24*d* of the inner surface 24*b* of the first skirt 24 and the mating sealing formation 16 of the bottle 12 are biased toward each other.

In another embodiment of the closure 10, the lower edge 24*e* of the first skirt 24 detaches from the frangible formations 32*c* of the first edges 32*a* of each the frangible members 32 upon lifting the tab 26. The first skirt 24 is moved from a closed position to an open position. The pair of hinge members 36 and the biasing member 38 allow the first skirt 24 to remain in the open position.

In a further embodiment of the closure 10, the frangible members 32 are each positioned at an angle greater than 0 degrees relative to a horizontal axis. In a specific embodiment, the frangible members 32 are each positioned at an angle from 0 degrees to 130 degrees, relative to the horizontal axis.

In yet another embodiment of the closure 10, the plurality of frangible members 32 is spaced around a portion of the circumference 24*a* of the first skirt 24, at 90 degrees, or less, angle increments.

In yet a further embodiment of the closure 10, the attachment formation 30 of the second skirt 28 is a plurality of threads (not depicted) spaced around the circumference of the inner surface 28*a* of the second skirt 28.

Referring again to the figures as above, in an embodiment, a closure 10 for closing a bottle 12 having a neck portion 14 including a mating sealing formation 16 and a mating attachment formation 18, includes a hinged sealing element 20. The hinged sealing element 20 includes a top wall 22 and a first skirt 24 extending downwardly from the top wall 22. The first skirt 24 includes a circumference 24*a*, an inner surface 24*b*, and an outer surface 24*c*. The inner surface 24*b* has a sealing formation 24*d* that allows engagement of the mating sealing formation 16 of the bottle 12. The sealing formation 24*d* includes an outer section 24*f* and an inner section 24*g*. The outer section 24*f* of the inner surface 24*b* of the first skirt 24 defines a circumference 24*h*, and the inner section 24*g* of the inner surface 24*b* of the first skirt 24 defines a circumference 24*i* smaller than the circumference 24*h* of the outer section 24*f*. A space 40 is between the outer section 24*f* and the inner section 34*g* to receive the mating sealing formation 16 of the bottle 12. The outer section 24*f* creates an outer seal 42 with the mating sealing formation 16 of the bottle 12. The inner section 24*g* creates a plug seal 44 with the mating sealing formation 16 of the bottle 12. A tab 26 is attached to the outer surface 24*f* of the first skirt 24. The first skirt 24 extends below and perpendicular to the top wall 22 down to a lower edge 24*e* of the first skirt 24.

The closure 10 also includes a second skirt 28 that defines an inner surface 28*a*, an outer surface 28*b*, a top edge 28*c*, and a circumference 28*d* larger than the circumference 24*a* of the first skirt 24. The inner surface 28*a* has an attachment formation 30 engageable with the mating attachment 18 formation of the bottle 12. The attachment formation 30 of the second skirt 28 includes a plurality of threads (not depicted) spaced around the circumference 28*d* of the inner surface 28*a* of the second skirt 28. The second skirt 28 extends downward in a same direction as the first skirt 24.

Further, the closure 10 includes a plurality of frangible members 32 that each have first and second edges 32*a*, 32*b* and are attached to a respective skirt 24, 28 to form a gap 34 between the first and second skirts 24, 28. The first edges 32*a* of the frangible members 32 are each attached to the first skirt 24 with frangible formations 32*c*.

The closure 10 also includes a pair of hinge members 36 that are each attached between the first and second skirts 24, 28 within the gap 34.

Additionally, the closure 10 includes a biasing member 38 attached to the first skirt 24 between the hinge members 36 and extending downwardly from the first skirt 24 to interact with the neck portion 14 of the bottle 12 such that the sealing formation 24*d* of the inner surface 24*b* of the first skirt 24 and the mating sealing formation 16 of the bottle 12 are biased toward each other.

In another embodiment of the closure 10, the lower edge 24*e* of the first skirt 24 detaches from the frangible formations 32*c* of the first edges 32*a* of each the frangible members 32 upon lifting the tab 26. The first skirt 24 is moved from a closed position to an open position. The pair of hinge members 36 and the biasing member 38 allow the first skirt 24 to remain in the open position.

In a further embodiment of the closure 10, the plurality of frangible members 32 is positioned at an angle from greater than 0 degrees to 75 degrees, relative to a horizontal axis. In a specific embodiment, the plurality of frangible members 32 section is positioned at an angle from 0 degrees to 135 degrees, relative to the horizontal axis.

In yet another embodiment of the closure 10, the plurality of frangible members 32 is spaced around a portion of the circumference 24*a* of the first skirt 24, at 90 degrees, or less, angle increments.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more than one component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A closure comprising:

a hinged sealing element comprising a top wall and a first skirt extending downwardly from the top wall, an inner surface, an outer surface, the inner surface comprising a sealing formation configured to engage a container, the first skirt extending from the top wall to a lower edge of the first skirt;

a second skirt pivotally coupled to the hinged sealing element, the second skirt defining an inner surface, an outer surface, and a top edge, the inner surface configured to couple to the container;

a plurality of frangible members extending between the first and second skirts, the plurality of frangible members configured to provide a visual indication when broken that the closure has been opened a first time;

a first hinge member extending between the first and second skirts, the first hinge member comprising a first upper portion coupled to the first skirt, a first lower portion coupled to the second skirt, and a first middle portion extending between the first upper portion and the first lower portion, wherein the first middle portion is thinner than at least one of the first upper portion and the first lower portion; and a second hinge member extending between the first and second skirts;

the first upper portion comprising an inner edge closest to the second hinge member and an outer edge furthest from the second hinge member, wherein the outer edge of the first upper portion extends a first distance towards the second skirt and the inner edge of the first upper portion extends a second distance towards the second skirt that is further than the first distance.

2. The closure of claim 1, further comprising a biasing member attached to the first skirt between the first hinge member and the second hinge member, the biasing member extending downwardly from the first skirt and configured to interact with a neck portion of the container when the closure has been opened.

3. The closure of claim 2, further comprising a tab extended from the outer surface of the first skirt away from the biasing member, wherein the tab is positioned opposite the biasing member.

4. The closure of claim 1, the hinged sealing element comprising an inner annular wall extending downward from the top wall, wherein a space between the first skirt and the inner annular wall is configured to receive a mating sealing formation of the container.

5. The closure of claim 1, wherein the first middle portion is thinner than both of the first upper portion and the first lower portion.

6. The closure of claim 5, the first lower portion comprising an inner edge closest to the second hinge member and an outer edge furthest from the second hinge member, wherein the outer edge of the first lower portion extends a third distance towards the first skirt and the inner edge of the first lower portion extends a fourth distance towards the first skirt that is further than the third distance.

7. The closure of claim 1, the second hinge member comprising a second upper portion coupled to the first skirt, a second lower portion coupled to the second skirt, and a second middle portion extending between the second upper portion and the second lower portion, wherein the second middle portion is thinner than at least one of the second upper portion and the second lower portion.

8. The closure of claim 7, wherein the second middle portion is thinner than both of the second upper portion and the second lower portion.

9. The closure of claim 7, the second upper portion comprising an inner edge closest to the first hinge member and an outer edge furthest from the first hinge member, wherein the outer edge of the second upper portion extends a third distance towards the second skirt and the inner edge of the second upper portion extends a fourth distance towards the second skirt that is further than the third distance.

10. The closure of claim 9, wherein the second middle portion is thinner than both of the second upper portion and the second lower portion.

11. The closure of claim 10, the second lower portion comprising an inner edge closest to the first hinge member and an outer edge furthest from the first hinge member, wherein the outer edge of the second lower portion extends a fifth distance towards the first skirt and the inner edge of the first lower portion extends a sixth distance towards the first skirt that is further than the fifth distance.

12. The closure of claim 11, wherein the first middle portion is thinner than both of the first upper portion and the first lower portion, the first lower portion comprising an inner edge closest to the second hinge member and an outer edge furthest from the second hinge member, wherein the outer edge of the first lower portion extends a seventh distance towards the first skirt and the inner edge of the first lower portion extends a eighth distance towards the first skirt that is further than the seventh distance.

13. A closure comprising:

a hinged sealing element including a top wall and a first skirt extending from the top wall, the hinged sealing element configured to detachably couple over an opening of a container;

a second skirt pivotally coupled to the hinged sealing element, the second skirt configured to engage with the container;

a plurality of frangible members extending between the first and second skirts, the plurality of frangible members configured to provide a visual indication when broken that the closure has been opened a first time;

a first hinge member extending between the first and second skirts, the first hinge member including a first upper portion coupled to the first skirt, a first lower portion coupled to the second skirt, and a first middle portion extending between the first upper portion and the first lower portion, wherein the first middle portion is thinner than at least one of the first upper portion and the first lower portion; and a second hinge member extending between the first and second skirts, the second hinge member including a second upper portion coupled to the first skirt, a second lower portion coupled to the second skirt, and a second middle portion extending between the second upper portion and the second lower portion, wherein the second middle portion is thinner than at least one of the second upper portion and the second lower portion;

the first lower portion including an inner edge closest to the second hinge member and an outer edge furthest from the second hinge member, wherein the outer edge of the first lower portion extends a first distance towards the first skirt and the inner edge of the first lower portion extends a second distance towards the first skirt that is further than the first distance.

14. The closure of claim 12, comprising a biasing member attached to the first skirt between the first hinge member and the second hinge member, the biasing member extending downwardly from the first skirt to interact with a neck portion of the container.

15. The closure of claim 12, wherein the first middle portion is thinner than both the first upper portion and the first lower portion.

16. The closure of claim 15, wherein the second middle portion is thinner than both the second upper portion and the second lower portion.

17. The closure of claim 12, wherein the first middle portion is thinner than both of the first upper portion and the first lower portion, the second middle portion is thinner than both of the second upper portion and the second lower portion, the second lower portion comprising an inner edge closest to the first hinge member and an outer edge furthest from the first hinge member, wherein the outer edge of the second lower portion extends a third distance towards the first skirt and the inner edge of the first lower portion extends a fourth distance towards the first skirt that is further than the third distance.

18. A closure comprising:

a hinged sealing element including a top wall and a first skirt extending from the top wall, the hinged sealing element configured to detachably couple over an opening of a container;

a second skirt pivotally coupled to the hinged sealing element, the second skirt configured to engage with the container;

a plurality of frangible members extending between the first and second skirts, the plurality of frangible members configured to provide a visual indication when broken that the closure has been opened a first time; and a first hinge member extending between the first and second skirts; and a second hinge member extending between the first and second skirts;

the first hinge member comprising a first upper portion coupled to the first skirt, a first lower portion coupled to the second skirt, and a first middle portion extending between the first upper portion and the first lower portion, wherein the first middle portion is thinner than at least one of the first upper portion and the first lower portion, wherein the first middle portion comprises an inner edge closest to the second hinge member and an outer edge furthest from the second hinge member, wherein the inner edge of the first middle portion extends a first distance between the first skirt and the second skirt and the inner edge of the first middle portion extends a second distance between the first skirt and the second skirt that is further than the first distance.

19. The closure of claim 18, further comprising a biasing member attached to the first skirt, the biasing member extending downwardly from the first skirt to a distal end furthest from the first skirt, the distal end configured to interact with a neck portion of the container.

20. The closure of claim 18, wherein the first middle portion is thinner than both the first upper portion and the first lower portion.

* * * * *